US006032398A

United States Patent [19]

Carpenteri et al.

[11] Patent Number: 6,032,398

[45] Date of Patent: Mar. 7, 2000

[54] CHOKE TUBE WRENCH

[76] Inventors: Harry L Carpenteri, 62 Main St., Milo, Me. 04463; Robert J. Knapp, R.R. 4 Box 3500, Houlton, Me. 04730

[21] Appl. No.: 09/126,370

[22] Filed: Jul. 30, 1998

Related U.S. Application Data

[60] Provisional application No. 60/054,926, Aug. 8, 1997.

[51] Int. Cl.[7] ..... F41A 35/00; F41C 27/00

[52] U.S. Cl. ..... 42/90; 42/79

[58] Field of Search ..... 42/79, 90; 123/119

[56] References Cited

U.S. PATENT DOCUMENTS

| | | | |
|---|---|---|---|
| 3,796,202 | 3/1974 | Guhman | 123/119 F |
| 4,837,962 | 6/1989 | Longerot | 42/90 |
| 4,862,544 | 9/1989 | Wallace | 7/118 |
| 4,951,409 | 8/1990 | Froid | 42/90 |
| 4,959,917 | 10/1990 | Mavrakis et al. | 42/90 |
| 5,151,552 | 9/1992 | Alessandri, Jr. | 42/90 |
| 5,317,825 | 6/1994 | Vatterott et al. | 42/79 |

*Primary Examiner*—Charles T. Jordan
*Assistant Examiner*—Denise J Buckley
*Attorney, Agent, or Firm*—William Nitkin

[57] ABSTRACT

A choke tube wrench for installation and removal of a choke tube in a shotgun barrel, such tool utilizable for a plurality of different gauge shotguns, such tool having an expandable section that fits within the choke tube and is expanded by squeezing the tool's handles together to tightly engage the inside of the choke tube so that upon rotation of the handles, the choke tube can be rotated for either installation in, or removal from, a shotgun barrel.

8 Claims, 2 Drawing Sheets

CHOKE TUBE WRENCH

This application claims benefit under 35 USC 119 (e) of U.S. Provisional Application under the same title, application No. 60/054,926 filed Aug. 8, 1997, now pending.

BACKGROUND OF THE INVENTION

1. Field of the Invention

The device of this invention resides in the field of shot gun choke tube removal devices and more particularly relates to a choke tube installation and removal tool that is utilizable for 10, 12, 16, 20 and 28 gauge shotguns.

2. History of the Prior Art

Shotguns are well known and generally have a smooth bore for shooting shot pellets at small game. A removal choke tube is disposed at the end of its barrel. Different choke tubes are utilizable for different types of shot, such as steel shot and lead shot. Different manufacturers provide specialized tools to install and remove their particular choke tubes. In general, though, the inside of the muzzle of the barrel is threaded and the exterior of the choke tube is provided with a matching thread such that the choke tube is screwed into the barrel muzzle. Often the threading inside the barrel muzzle is cut into the muzzle a distance such that the bore of the choke tube aligns with the bore of the barrel. Different choke tubes are used to achieve different shot patterns from the same shotgun. For example, when hunting one type of game bird, a widely dispersed shot pattern may be desirable while a more compact shot pattern may be desired for hunting a different type of bird. To change the shot pattern, the gun user would change the choke tube. When it is desired to replace the choke tube, the old choke tube is removed by unscrewing it from the muzzle and screwing in a new choke tube. Shotguns come in different barrel diameters such as 10, 12, 16, 20 and 28 gauge bores so that different tools are needed to remove and replace different size choke tubes.

SUMMARY OF THE INVENTION

It is an object of this invention to provide a single tool to remove and install screw-in choke tubes for shotguns of multiple gauges so as to eliminate the need for a multi-gun gun owner to have a separate wrench for each different gauge shotgun that he may own. The device of this invention has means to expand itself inside the choke tube so as to exert a strong holding pressure on the interior of the choke tube when the tool's handles are squeezed together. While the handles are squeezed together exerting a strong gripping pressure, a locking lever can be engaged which will maintain the gripping pressure of the tool inside the choke tube. The choke tube wrench of this invention can then be rotated clockwise or counterclockwise while gripping the choke tube in the barrel to install or remove the choke tube as described in further detail below.

DESCRIPTION OF THE PREFERRED EMBODIMENT(S)

Figure 1:
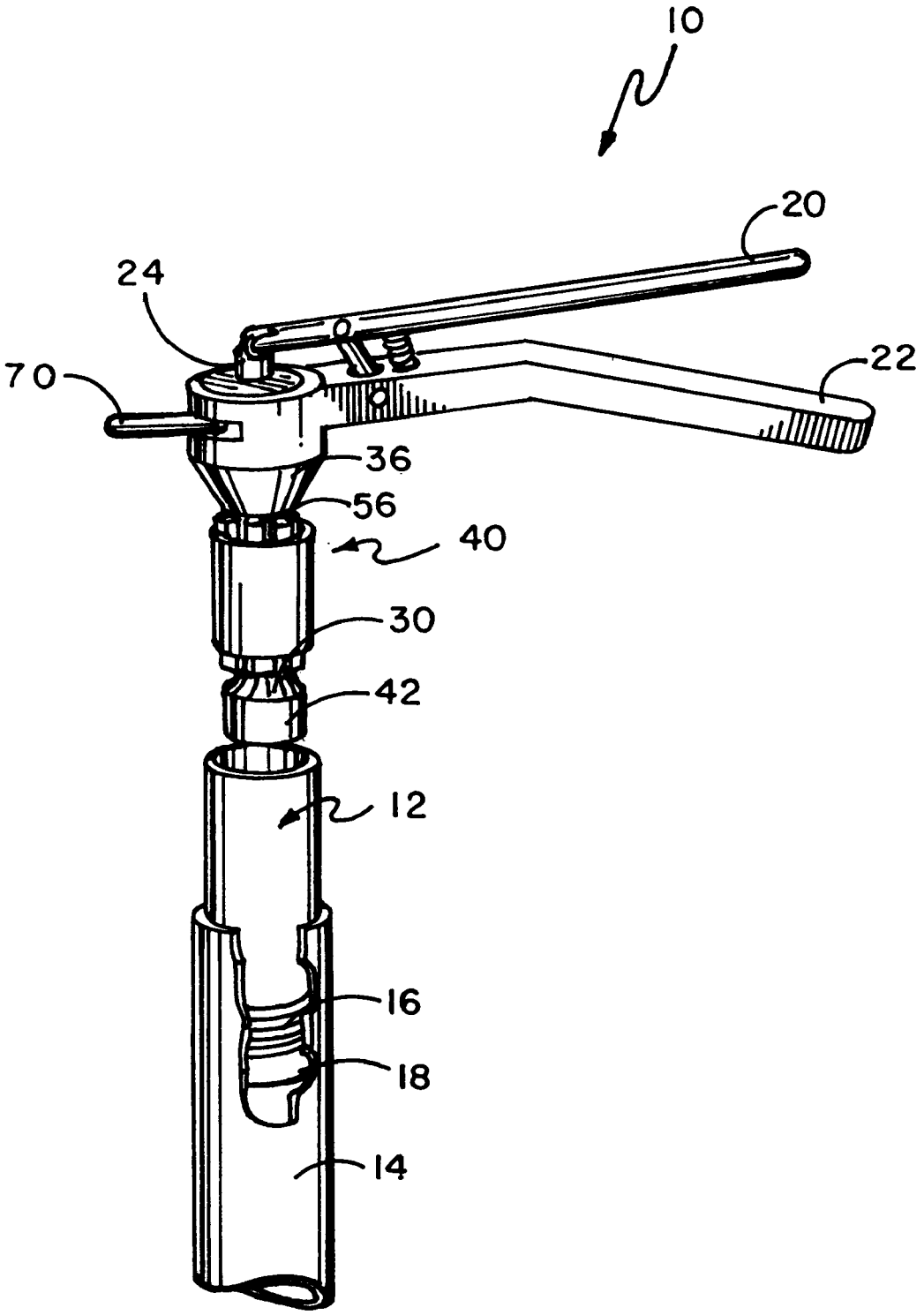
FIG. 1 illustrates a perspective view of the device of this invention about to be inserted into the choke tube of a gun barrel.

FIG. 1 illustrates a view of tool 10 of this invention about to be inserted into choke tube 12 which choke tube 12 is engaged in shotgun barrel 14 by threads 16. The choke tube is installed by screwing it into barrel 14 down to shoulder 18. When the tool is inserted into choke tube 12, upper handle 20 and lower handle 22 are squeezed together which action raises draw bar 24, seen best in FIG. 2, to cause rubber-covered expander 26 to expand inside rubber sleeve 40, thereby gripping the inside of choke tube 12 sufficiently so that it can be either rotated clockwise for installation, or counterclockwise for removal, of the choke tube.

Figure 2:
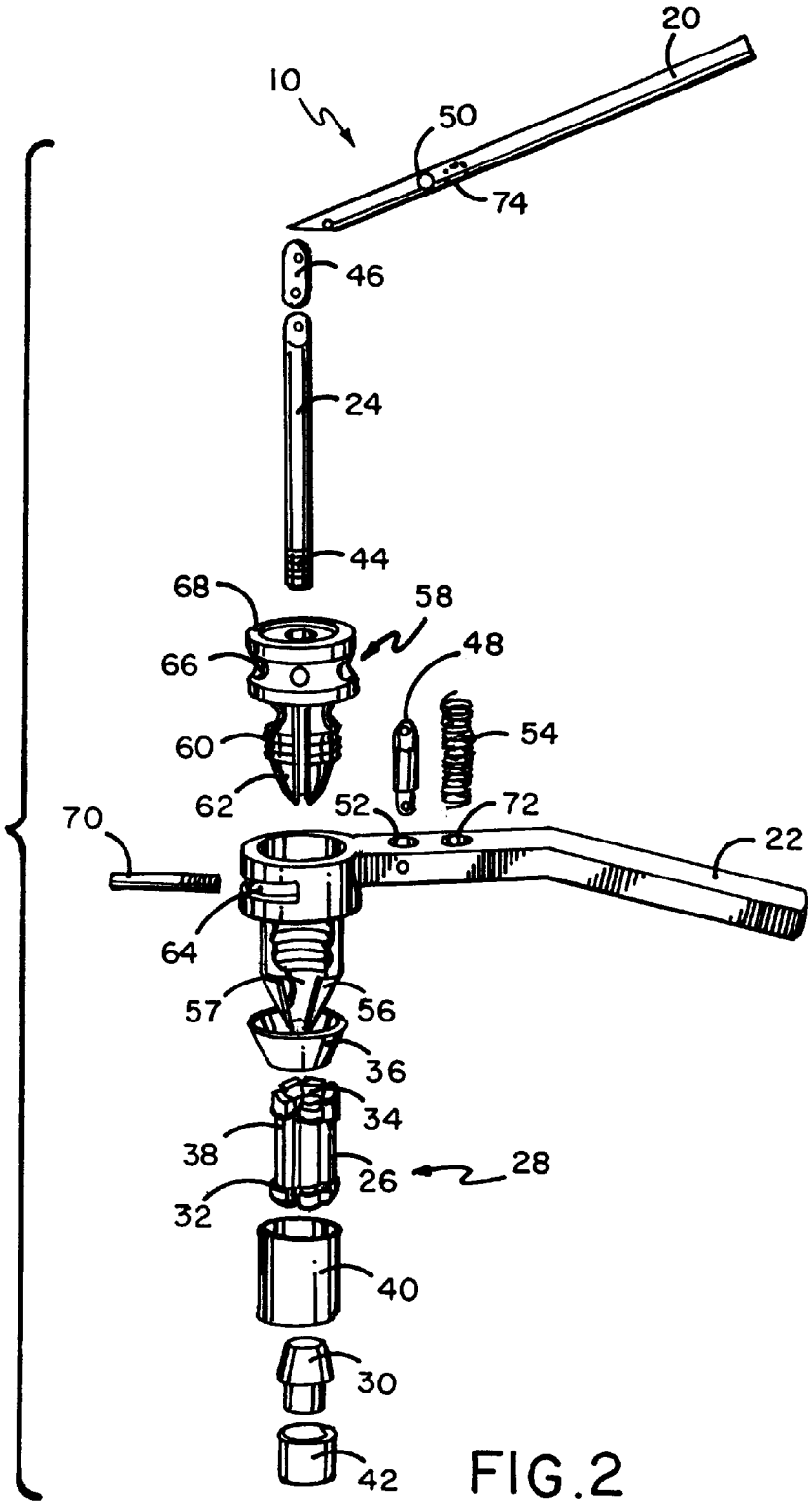
FIG. 2 illustrates an exploded view showing the parts of the tool separated from one another.

FIG. 2 illustrates the parts of tool 10 in exploded form. Seen in this view is the four-part gripper expander 28 through which draw bar 24 passes. When draw bar 24 is raised by downward pressure on upper handle 20, it pulls attached expander nut 30 upwards. The top of expander nut 30 is tapered and meets with the lower inside taper 32 of each expander element 26 of gripper expander 28, forcing the expander elements 26 of gripper expander 28 apart from one another. At the same time, the gripper expander's upper inside taper 34 on each expander element is forced against tapered upper expander 56 which is part of the lower handle assembly which action forces gripper expander 28 apart at its top. Surrounding the gripper expander and disposed partially within and around insert 38 on the outer portion of each expander element 26 of gripper expander 28 is rubber sleeve 40. End cap 42, made of Delrin brand plastic or equivalent, can be fitted over the bottom of expander nut 30 to prevent damage from any metal-to-metal contact when the tool is placed inside the choke tube. Around the tapered upper expander 56 is disposed a tapered cone 36, which also can be made of Delrin plastic or equivalent material, which aids when tapered cone 36 comes in contact with the opening of the choke tube to help center the alignment of rubber sleeve 40 inside choke tube 12. Tapered cone 36, also being made of softer material than metal, further helps prevent damage from metal-to-metal contact with the choke tube. Expander nut 30 can be screwed onto the threaded bottom 44 of draw bar 24. Draw bar 24 is attached to upper handle 20 through draw bar link 46, and upper handle 20 is additionally attached to lower handle 22 by a pivotal attachment to pivot pin 48. Pivot pin 48 is pivotally attached to first pivot aperture 50 in upper handle 20, and pivot pin 48 is pivotally attached at its bottom to second pivot aperture 52 defined in lower handle 22. A spring 54 is positioned adjacent to pivot pin 48 having its first end held in recess 72 in lower handle 22 and its second end held in recess 74 in upper handle 20, and such spring is of sufficient length and springiness to urge upper handle 20 away from lower handle 22 when handles 20 and 22 are not manually squeezed together. When upper handle 20 and lower handle 22 are manually squeezed together, the upper handle pivots on the top of pivot pin 48 which acts as a fulcrum and pulls the attached draw bar link 46 and its attached draw bar 24 upwards in relation to lower handle 22, causing expander nut 30 to move upwards in relation to gripper expander 28 and forcing expander elements 26 of gripper expander 28 apart at their bottoms and at the same time forcing expander elements 26 apart at their tops where they contact tapered upper expander 56. This outward expansion of gripper expander 28 stretches rubber sleeve 40 outward until it makes contact with the interior bore of choke tube 12. The fact that the rubber sleeve can be expanded from a diameter of 0.525 to 0.775 inch allows tool 10 to be utilizable for a wide variety of different sized choke tubes. The combination of the high coefficient of friction of rubber sleeve 40 and the high pressure of the gripper expander 28 thereagainst causes rubber sleeve 40 to exert a strong force against the inside bore of whatever choke tube it has been inserted in.

Moreover, the lateral extension of the handles at a substantial right angle to rubber sleeve 40 allows the user to gain substantial leverage in rotating and screwing in or unscrewing the choke tube.

Once the upper handle has been lowered to expand the gripper expander, a locking mechanism can be utilized so that once the locking mechanism is engaged, the manual squeezing of the upper and lower handles together can cease while the tool remains engaged in the bore so that lateral force to rotate the tool can then be more easily manually applied. Lower handle 22 has tapered upper expander 56 protruding from the bottom thereof which is hollow first to receive draw bar 24 therethrough and then to receive locking cone 58 therein. A threading can be provided on the interior of the hollow portion of tapered upper expander 56 to receive in threaded engagement, locking cone threads 60. Locking cone 58 has split lower ends 62 designed to surround draw bar 24 which passes therethrough. A tapered aperture 57 is formed within tapered upper expander 56 of a size to receive the tapered split lower ends 62 of locking cone 58 such that when locking cone 58 is rotated with its locking cone threads engaged in the threads within tapered aperture 57 in tapered upper expander 56, the sides of split lower ends 62 of locking cone 58 are forced together by their pressure against the inside of tapered aperture 57, thereby forcing split lower ends 62 tightly against draw bar 24 and thereby locking draw bar 24 in place at the position the draw bar was in at the time of the rotation of locking cone 58. In order to rotate locking cone 58, elongated slot 64 is formed at one end of lower handle 22, such slot 64 opening into tapered aperture 57, and a plurality of lock apertures 66 are provided around upper portion 68 of locking cone 58. A locking lever 70, threaded at one end, is screwed into a selected lock aperture 66 through elongated slot 64 such that when locking lever 70 is rotated, it screws locking cone 58 downward, tightening its split lower ends 62 against draw bar 24 and thereby locking draw bar 24 in position.

Although the present invention has been described with reference to particular embodiments, it will be apparent to those skilled in the art that variations and modifications can be substituted therefor without departing from the principles and spirit of the invention.

We claim:

1. A device for installing a choke tube in a shotgun barrel and removing said choke tube therefrom, comprising:

an upper handle having a first end and a second end;

a pivot member having a first end and a second end;

a lower handle having a first end and a second end, said pivot member pivotally mounted to said second end of said lower handle, said pivot member's first end being pivotally mounted to said second end of said upper handle;

a tapered expander having an upper portion, said tapered expander disposed at said first end of said lower handle, said tapered expander having an aperture defined therein;

a draw bar having a first end and a second end, said draw bar at its first end being attached to said first end of said upper handle, said draw bar passing through said aperture at the first end of said lower handle;

a gripper expander including:

a plurality of expander elements, each having a top, a bottom and an inner surface and an outer surface, said expander elements being inwardly tapered at their top inner surface and bottom inner surface, said gripper expander disposed around said draw bar beneath said tapered expander;

a tapered expander nut having a bottom said tapered expander nut attached to said second end of said draw bar;

a rubber-like sleeve positioned around said gripper expander such that when said upper handle is pivoted on said pivot member toward said lower handle, said draw bar moves upward, pulling said expander nut against the bottom of said expander elements and moving said expander elements upwards against said tapered expander with said expander elements being forced outwards by the action of the tapered expander and tapered expander nut contacting said inward taper on said top and bottom of said inside of said expander elements, thereby increasing the diameter of said rubber-like sleeve to engage the bore of the choke tube for rotation of said choke tube.

2. The device of claim 1 further including a locking mechanism to retain said gripper expander in its tightened position in said choke tube.

3. The device of claim 2 wherein said locking mechanism further includes:

a tapered aperture defined within said tapered expander;

a locking cone having split lower ends positioned in said tapered aperture; and means to force said locking cone split lower ends against the sides of said tapered aperture to force said split lower ends against said draw bar to lock said draw bar in position.

4. The device of claim 3 further including:

a spring member for urging said upper and lower handles apart when said device has its gripper expander in a non-expanded position to return said draw bar to its fully extended position, lowering said expander nut to allow said expander elements that are then not being forced apart from one another to return by pressure from said rubber-like sleeve to their position immediately around said draw bar.

5. The device of claim 4 wherein said means to force said locking cone split lower ends against said draw bar comprises:

screw threads defined within said tapered aperture;

mating screw threads defined on said locking cone;

a slot defined in said lower handle, said slot entering said tapered aperture; and a lever engaged through said slot into said locking cone to rotate said locking cone for said threads on said locking cone when rotated in one direction to raise said cone to an unlocked position and when rotated in the other direction to lower said cone to a locked position.

6. The device of claim 5 wherein said expander elements of said gripper expander each have an insert area defined within their outer surfaces for receipt of said rubber-like sleeve therein.

7. The device of claim 6 wherein said upper handle further includes:

a pivotally attached draw bar link disposed between said first and second ends of said upper handle and said first end of said draw bar.

8. The device of claim 7 further including:

a plastic end cap disposed on the bottom of said expander nut; and a plastic cone having an aperture defined therein, said plastic cone disposed around said upper portion of said tapered expander.

* * * * *